US006718902B1

(12) United States Patent
Lower

(10) Patent No.: US 6,718,902 B1
(45) Date of Patent: Apr. 13, 2004

(54) WALKWAYS FOR PLATFORMS ON OFFSHORE MARINE STRUCTURES

(75) Inventor: J. Donald Lower, Houston, TX (US)

(73) Assignee: Duron Systems, Inc., Houston, TX (US)

( * ) Notice: Subject to any disclaimer, the term of this patent is extended or adjusted under 35 U.S.C. 154(b) by 0 days.

(21) Appl. No.: 10/318,954

(22) Filed: Dec. 13, 2002

(51) Int. Cl.[7] ..... B63B 35/44
(52) U.S. Cl. ..... 114/264; 114/362; 14/71.1
(58) Field of Search ..... 114/263, 264, 114/362; 405/218, 219, 220; 14/71.1, 71.5; 414/537

(56) References Cited

U.S. PATENT DOCUMENTS

| | | | | | |
|---|---|---|---|---|---|
| 2,803,841 | A | * | 8/1957 | Wellens | 14/71.1 |
| 3,228,051 | A | * | 1/1966 | Voase et al. | 14/71.1 |
| 3,604,532 | A | * | 9/1971 | Moore | 114/362 |
| 4,003,473 | A | * | 1/1977 | Ryan | 14/71.7 |
| 4,011,615 | A | | 3/1977 | Maxson et al. | 14/71.1 |
| 4,133,067 | A | * | 1/1979 | Bennett et al. | 14/71.3 |
| 4,133,283 | A | * | 1/1979 | Ryan | 114/230.18 |
| 4,421,051 | A | * | 12/1983 | Hammett | 114/264 |
| 4,473,916 | A | * | 10/1984 | Connold | 14/71.5 |
| 4,498,412 | A | * | 2/1985 | Liden | 114/264 |
| 4,590,634 | A | * | 5/1986 | Williams | 14/71.1 |
| 4,838,735 | A | * | 6/1989 | Warner | 405/220 |
| 5,077,852 | A | * | 1/1992 | Karlsson | 14/71.1 |
| 5,085,165 | A | * | 2/1992 | Reed | 114/362 |
| 5,244,335 | A | * | 9/1993 | Johns | 414/537 |
| 5,813,071 | A | * | 9/1998 | Breslin et al. | 14/71.1 |
| 5,833,397 | A | * | 11/1998 | Horton, III | 114/264 |
| 6,067,926 | A | | 5/2000 | Robinson | 114/362 |
| 6,125,780 | A | * | 10/2000 | Sweetman et al. | 114/264 |
| 6,345,950 | B1 | * | 2/2002 | Gerwitz | 414/537 |

* cited by examiner

*Primary Examiner*—S. Joseph Morano
*Assistant Examiner*—Lars A. Olson
(74) *Attorney, Agent, or Firm*—Loren G. Helmreich; Browning Bushman, P.C.

(57) ABSTRACT

A walkway for extending between a pair of adjacent platforms on offshore marine structures including a pair of slidable sections having floors or decks which overlap each other. Interfitting support members which extend along opposed sides of the sliding sections support the slidable sections for sliding movement.

21 Claims, 7 Drawing Sheets

24
26A
26B
35A
36A
34A
34B
30A
30B
54A
52A
50A 24
37A
37B
35A
45B
46B
44A
44B
42B
28A
28B
36A
36B
30A
30B
34A
34B
26A
26B

WALKWAYS FOR PLATFORMS ON OFFSHORE MARINE STRUCTURES

FIELD OF THE INVENTION

This invention relates to walkways for platforms on offshore marine structures and more particularly to walkways between adjacent platforms which move relative to each other, particularly in a vertical direction.

BACKGROUND OF THE INVENTION

In an offshore marine structure, such as an offshore production facility, a moon pool is oftentimes provided in the production deck or platform in which a plurality of production wellhead assemblies are mounted. Each of the production wellhead assemblies has a platform on which workmen may be supported while servicing a wellhead such as the valves and actuators on the wellhead. Workmen must walk or travel between adjacent platforms in order to have access to the associated wellhead assembly for various reasons, such as installations, maintenance, replacement, repair, and operations, for example. Heretofore it has been common to provide metal planks between adjacent platforms which would be removed in the event of storms, high seas, or when not in use. Substantial relative movement, particularly vertical movement, occurs between adjacent platforms which movement, for example, may be as much as 4 or 5 feet between adjacent platforms. The platform which forms a production deck of an offshore facility may have even greater vertical movement relative to the wellhead platforms, such as 10 to 15 feet resulting from high seas or storms. Relative horizontal movement also occurs between adjacent platforms and walkways must be capable of compensating for such relative movement between adjacent platforms which are connected by walkways.

It is desirable that walkways for offshore marine structures be provided between adjacent platforms or supporting surfaces with the walkways being adapted to compensate for relative movements between the adjacent platforms and provide safety for workmen to travel over between the adjacent platforms.

U.S. Pat. No. 4,011,615 issued Mar. 15, 1977, shows a gangway for connection between a ship and a fixed structure such as an offshore platform. The gangway in one embodiment shows a pair of box-type sections arranged for sliding movement relative to each other with shock absorbers to control the speed of the relative movement to limit the rate at which tension or compression is applied. U.S. Pat. No. 4,011,615 does not show any support rods and associated bearings for supporting the sections for sliding movement to minimize the frictional contact between the slidable sections and to provide accurate guiding of the slidable section upon relative movement.

U.S. Pat. No. 6,067,926 dated May 30, 2000, discloses a portable ramp extending between a dock and a boat with a pair of telescoping slidable sections. The slidable sections are provided for mounting of the ramp onto the boat and dock. However, during operation after mounting the ramp, the slidable connections are connected to each other so that relative movement is not provided.

SUMMARY OF THE INVENTION

The present invention is directed to a ramp or walkway particularly adapted for use between platforms on an offshore facility in which relative vertical and movement of substantial distances, such as 5 to 15 feet, may be obtained between adjacent platforms over which walkways workmen travel between adjacent structures in a safe manner. The walkway is formed of two sliding walkway sections which are mounted between the adjacent platforms and, upon relative movement between the adjacent platforms, the walkway sections slide relative to each other to compensate for the relative movement. The walkway may extend between a pair of adjacent platforms, for example, such as wellhead platforms provided adjacent wellhead assemblies mounted in a moon pool in the production deck of an offshore facility. The walkway may extend between a platform on the production deck and a wellhead platform so that workmen from the production deck may have access to the wellheads along a safe walkway. The walkways are designed to remain in place in the event of storms or high seas.

The present invention includes two walkway embodiments, one embodiment for extending between a pair of wellhead platforms, and the other embodiment for extending between a wellhead platform and an upper platform on the production deck. Each sliding walkway section has a walkway floor or deck on which a workman is supported for walking between adjacent platforms. The walkway floor on one sliding section is mounted over a walkway floor for the other sliding section and an extending end portion on one walkway section overlaps an extending end portion on the other walkway section. Relative vertical and horizontal movements frequently occur between adjacent platforms and the walkway of the invention is effective to compensate for such movements.

The pair of sliding walkway sections are connected to the adjacent platforms by a removable connection comprising interfitting connecting members on each sliding section and an adjacent platform for removably connecting the sliding sections to the pair of selected platforms. The interfitting connecting members may comprise a tubular member secured to an outer end of each sliding section and a support rod removably connected to an adjacent platform received within the tubular member. The tubular member preferably has a diameter substantially greater, such as five times greater, than the diameter of the support rod so that a substantial relative movement of 5 inches, for example, may be provided between each rod and the receiving tubular member on the sliding walkway section.

An object of the invention is to provide a walkway between adjacent platforms of an offshore facility which effectively compensates for relative vertical and horizontal movements between the adjacent platforms.

A further object of the invention is to provide such a walkway which includes a pair of slidable walkway sections having floors which overlap each other and with each section having an outwardly extending end removably connected to an adjacent platform.

Another object of the invention is to provide a walkway having a pair of slidable walkway sections which slide relative to each other under minimal frictional forces.

Other objects, features, and advantages of the walkway comprising the present invention will be apparent from the following drawings.

DETAILED DESCRIPTION OF PREFERRED EMBODIMENTS

Figure 1:
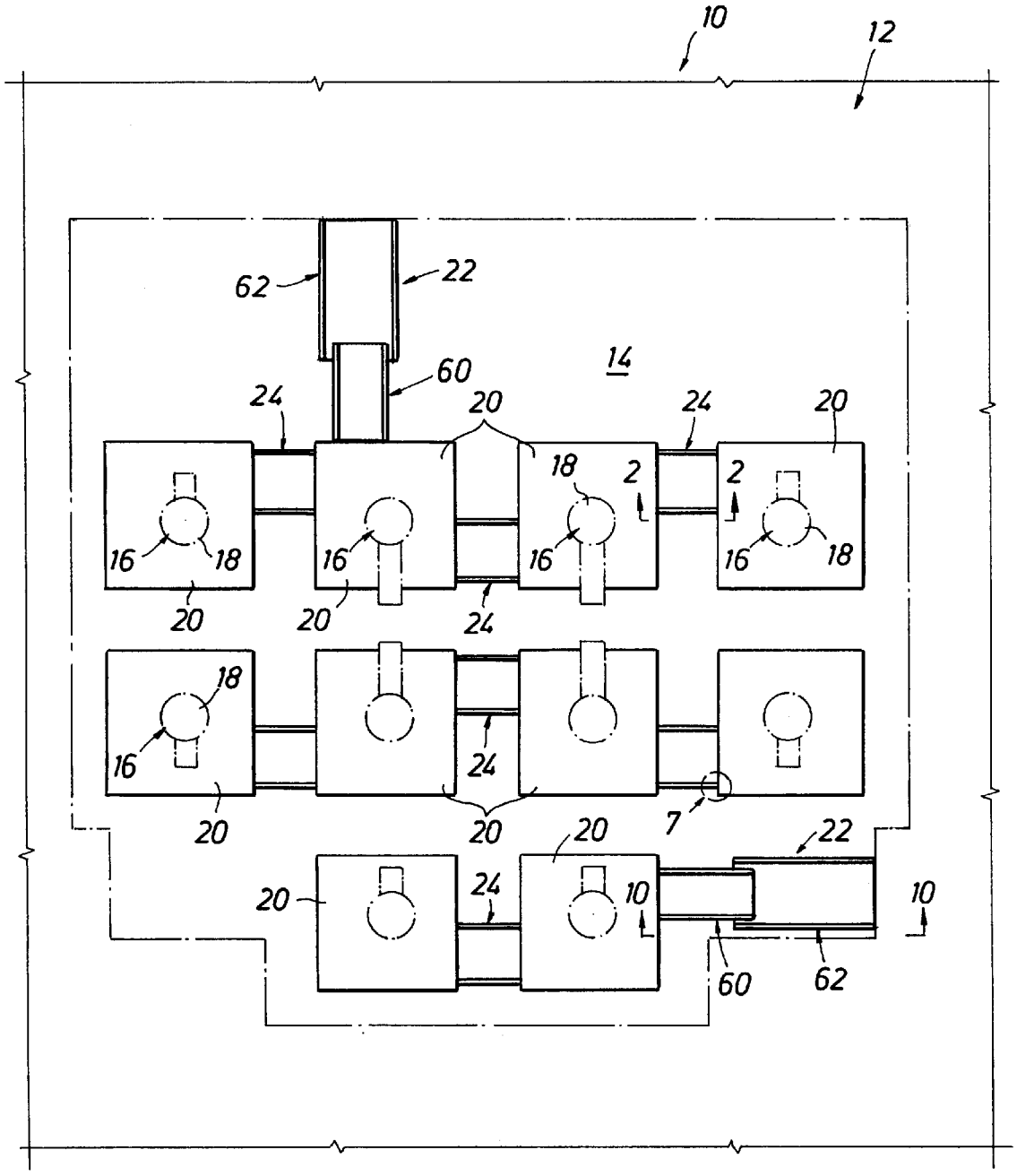
FIG. 1 is a plan view of an offshore facility showing a moon pool extending through a production deck of the offshore facility with a plurality of wellhead assemblies mounted in the moon pool each wellhead assembly having a platform adjacent the wellhead assembly.

Referring now to the drawings for a better understanding of this invention, and more particularly to FIG. 1, an offshore facility is indicated generally at 10 which may comprise an offshore production facility having a production deck or upper platform shown generally as 12 with a moon pool shown generally at 14 extending through the production platform 12. Mounted in moon pool 14 are a plurality of wellhead assemblies 16 each including a wellhead 18 and an upper platform 20 adjacent wellhead 18 so that a workman standing on platform 20 has easy access to wellhead 18 and associated equipment such as valves and actuators.

Figure 11:
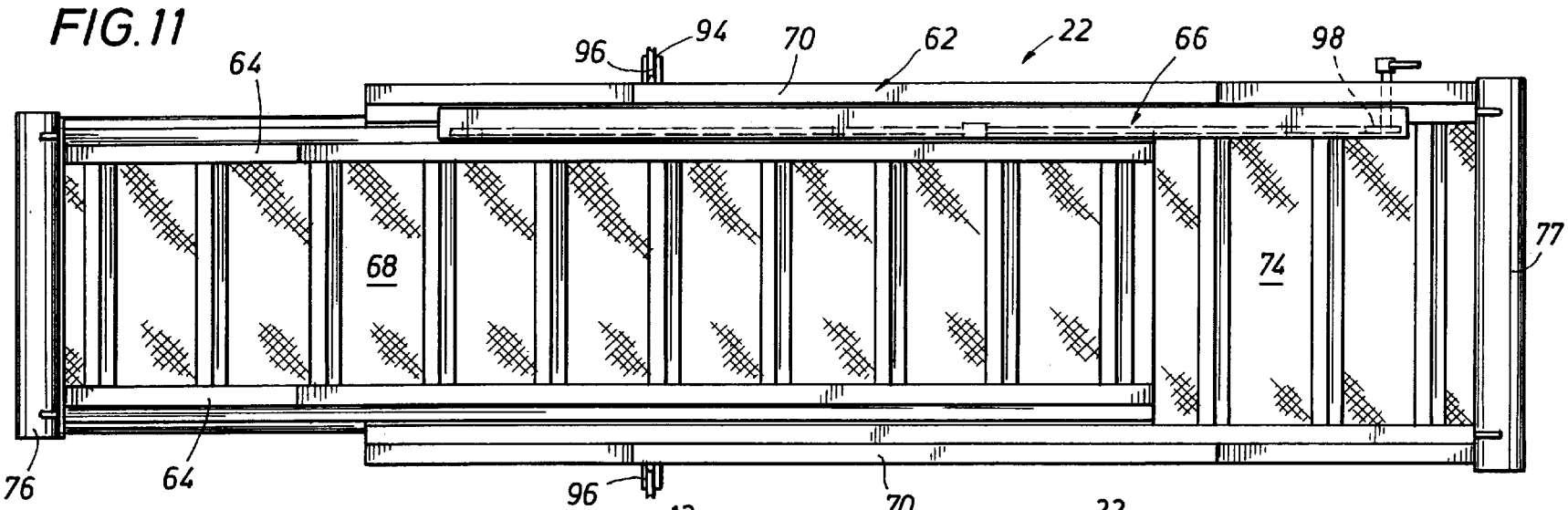
FIG. 11 is a top plan view of the walkway shown in FIG. 10.

Mounted between platform 12 on the production deck and an adjacent wellhead platform 20 of wellhead assembly 16 are walkways generally indicated at 22. Walkways generally indicated at 24 are mounted between a pair of adjacent wellhead platforms 20 on adjacent wellhead assemblies 16. Walkways 22 and 24 illustrate different embodiments of the invention with walkway 24 being illustrated in FIGS. 2–9 while walkway 22 is specifically illustrated in FIGS. 10–12.

WALKWAY EMBODIMENT SHOWN IN FIGS. 2–9

Walkway 24 as shown in FIGS. 2–9 includes a pair of sliding walkway sections 26A and 26B which are generally assembled with walkway section 26A comprising an upper walkway section and walkway section 26B comprising a lower walkway section. Similar numerals on walkway sections 26A and 26B are employed for similar parts. Upper walkway section 26A has on opposed sides thereof a channel-shaped side beam 28A. Horizontal cross members 30A extend between and are secured to beams 28A. A diagonal member 32A as shown particularly in FIG. 3 extends between opposed ends of upper walkway section 26A. A grated deck 34A is supported on horizontal cross members 30A and gripping members 36A extend across the upper surface of grated deck 34A to minimize any slipping of workmen on the walkway. A lower side rail or toeboard 35A generally of an angle shape is mounted on each side beam adjacent grated deck 34A to provide a side guide and restrict lateral movement of the feet of a workman.

Figure 2:
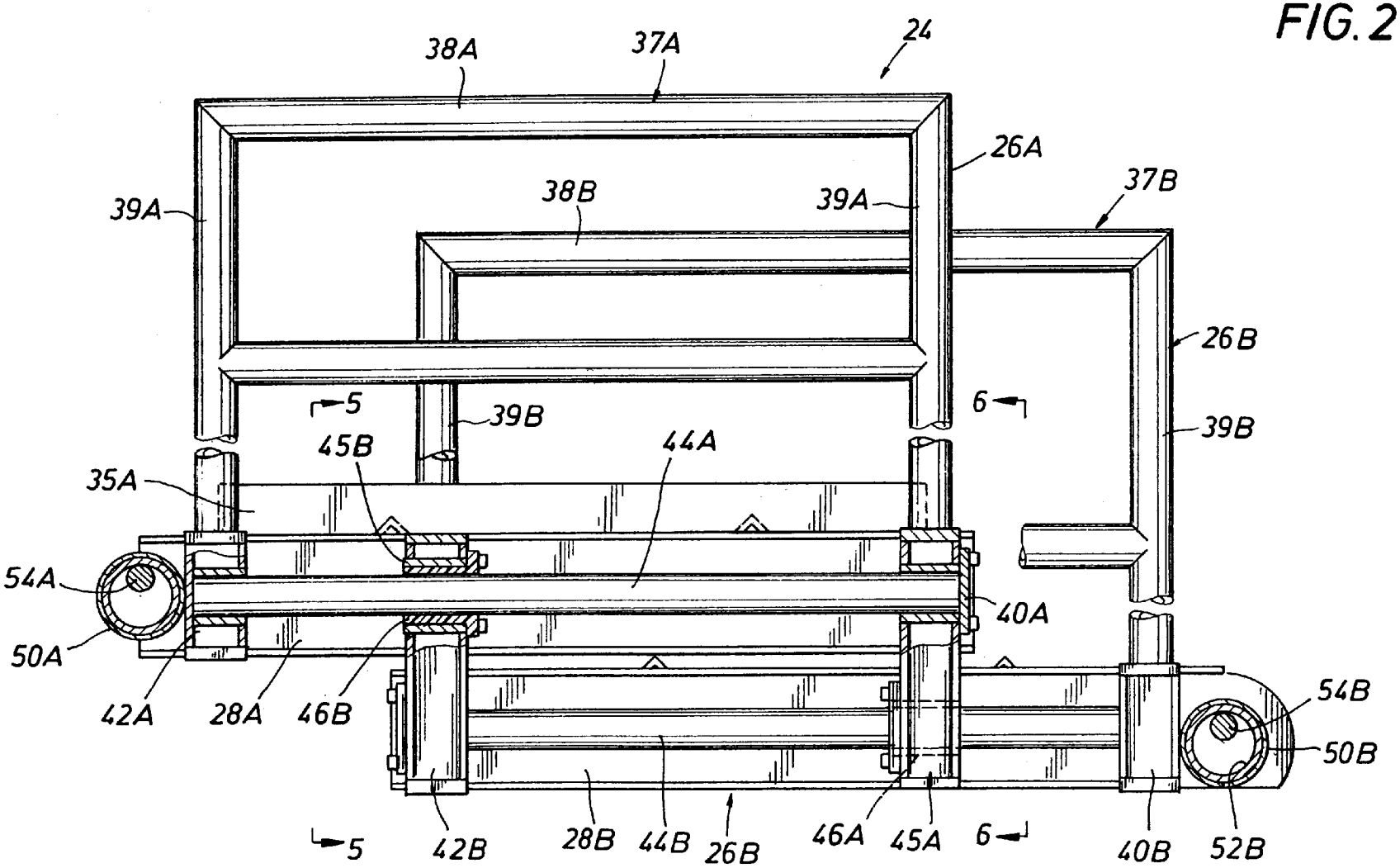
FIG. 2 is a section taken generally along line 2—2 of FIG. 1 and showing a walkway for mounting between a pair of adjacent wellhead platforms to permit a workman to walk between the platforms.
Figure 3:
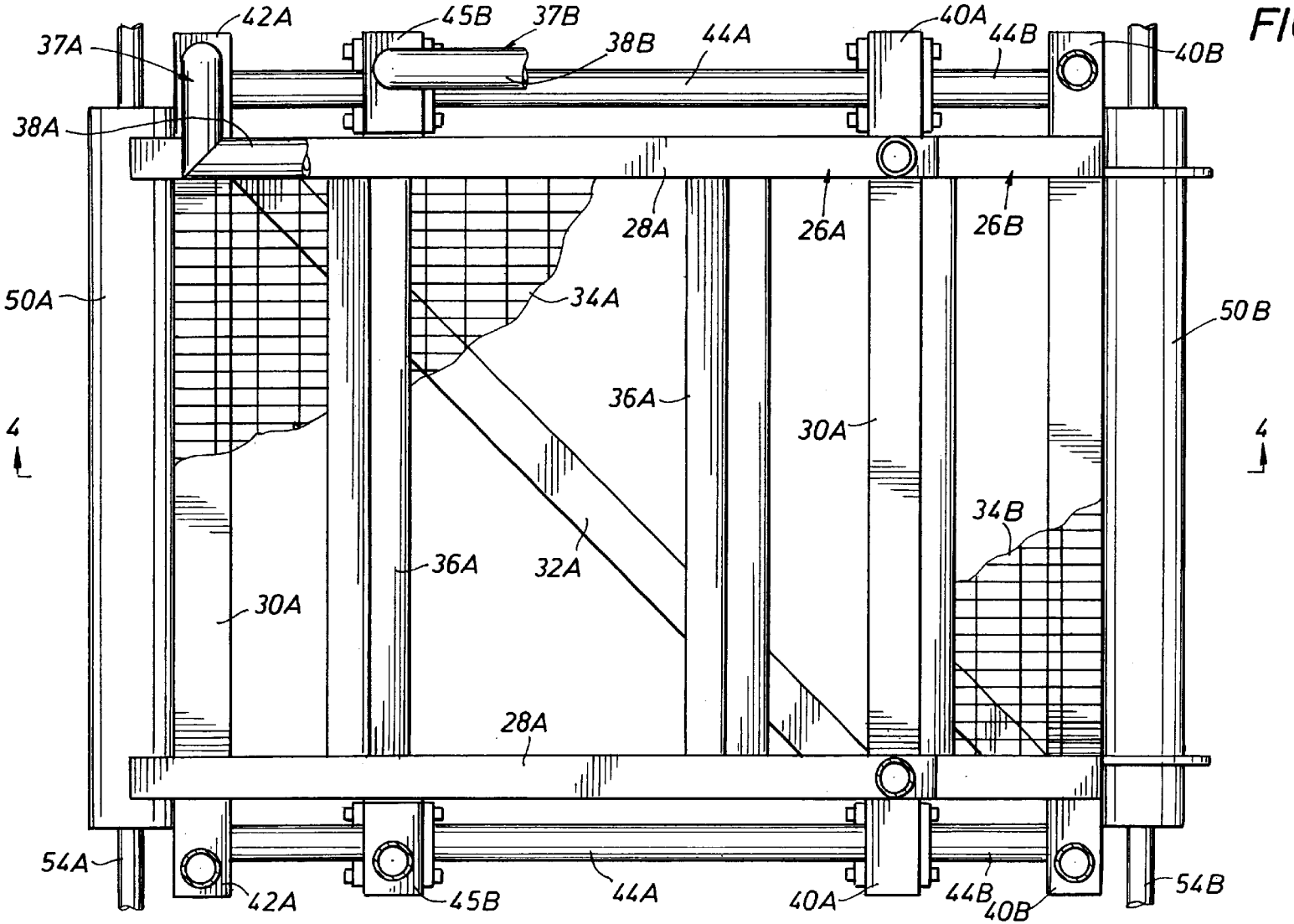
FIG. 3 is a top plan view of the walkway shown in FIG. 2.
Figure 4:
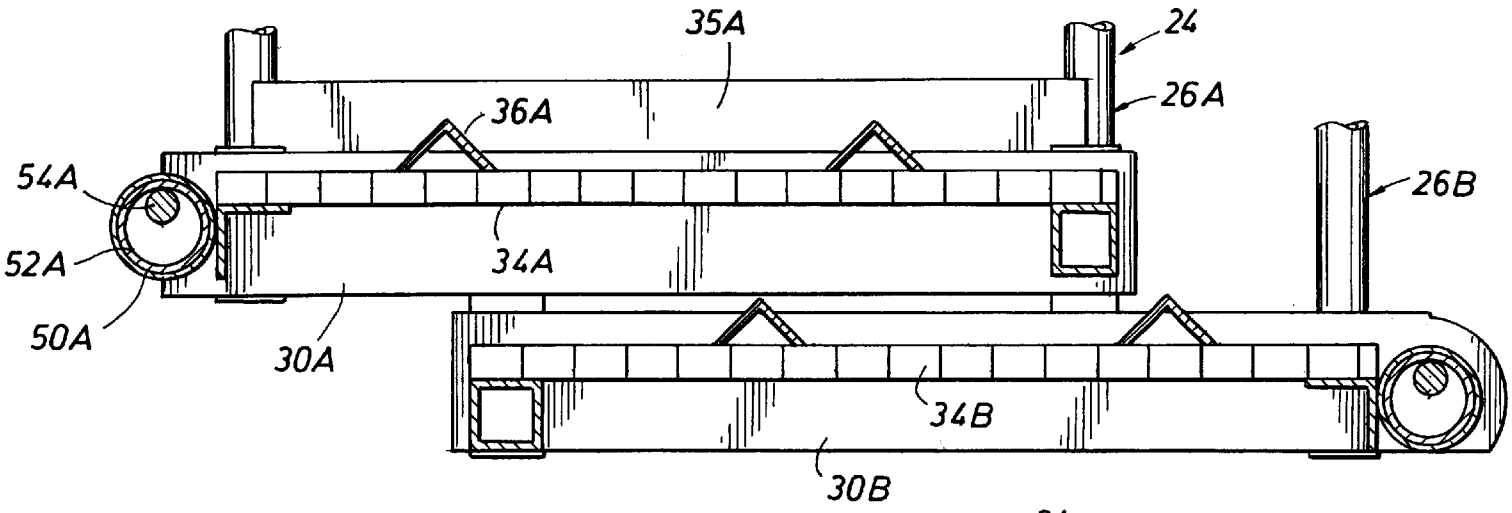
FIG. 4 is a section taken generally along the line 4—4 of FIG. 3.
Figure 5:
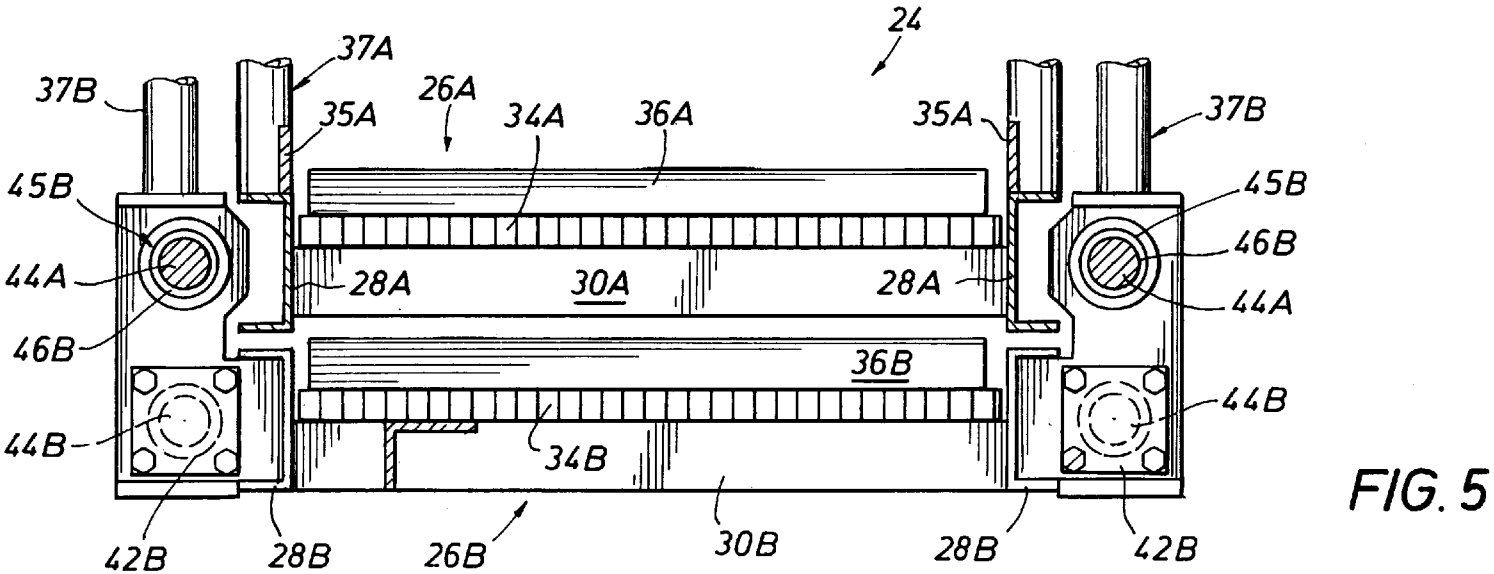
FIG. 5 is a section taken generally along the line 5—5 of FIG. 2.
Figure 6:
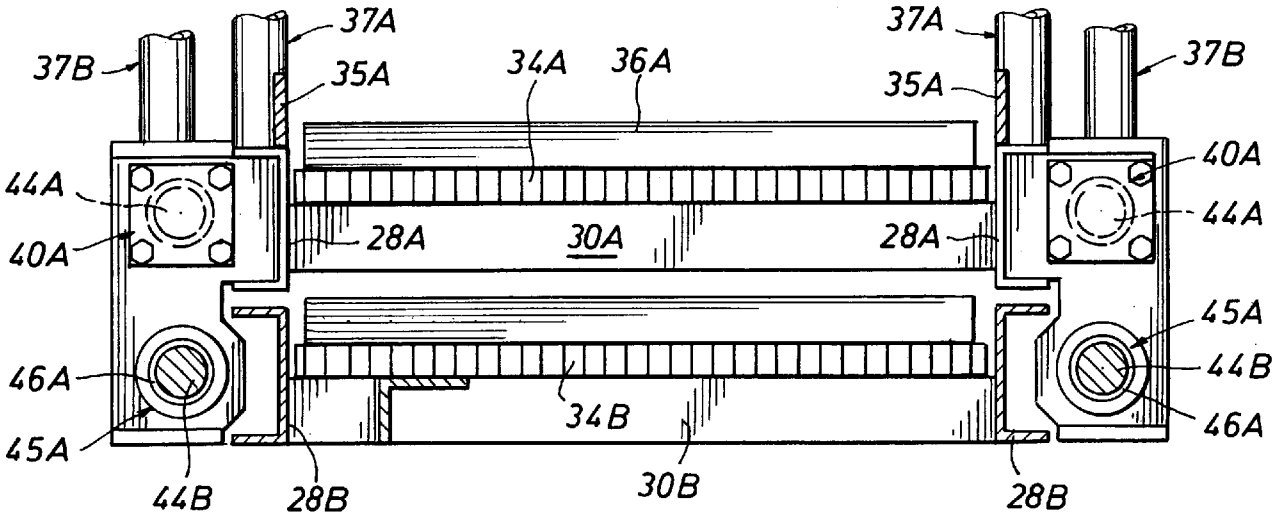
FIG. 6 is a section taken generally along the line 6—6 of FIG. 2.

A side rail structure generally indicated at 37A for each side of upper walkway section 26A includes a horizontal upper hand rail 38A supported by vertical frame members 40A secured to side beams 28A. If desired, the side rail structure may be mounted alongside walkway section 26A without being connected to the walkway section. Each channel-shaped side beam 28A has on opposed ends thereof upper end bearings 40A and 42A which receive and support opposed ends of an upper support rod or shaft 44A as shown in FIG. 2. As shown particularly in FIGS. 2 and 6, an additional lower intermediate bearing 45A is supported from inner end bearing 40A and beam 28A below bearing 40A. A lower rod 44B on lower walkway section 26B is received within lower intermediate bearing 45A and upper rod 44A is received within upper intermediate bearing 45B secured to lower walkway section 26B. Upper intermediate bearing 45B is supported from lower end bearing 42B and beam 28B above lower end bearing 42B as shown particularly in FIGS. 2 and 5. A bearing sleeve 46B of upper intermediate bearing 45B receives rod 44A. A similar bearing sleeve 46A on lower intermediate bearing 45A receives lower support rod 44B. Lower support rod 44B is mounted within lower end bearings 40B and 42B on lower slidable section 26B as shown. Thus, upper walkway section 26A is supported and guided by intermediate bearing 45B which receives rod 44A. Likewise, lower walkway section 26B is guided and supported by intermediate bearing 45A which receives and supports rod 44B for relative sliding movement. Sliding walkway sections 26A and 26B are thus mounted for sliding movement relative to each other by rods 44A and 44B supported by end bearings 40A, 40B, 42A, 42B and intermediate bearings 45A, 45B.

Figure 9:
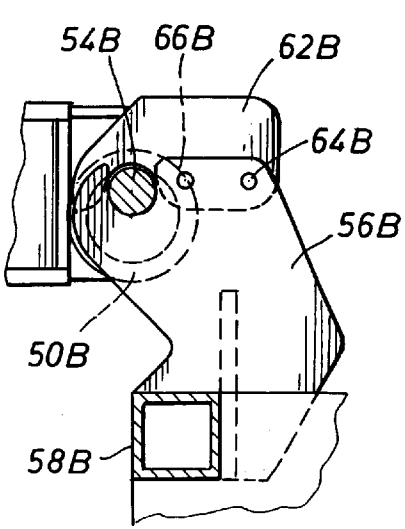
FIG. 9 is a view similar to FIG. 8 but showing the walkway in a releasably locked position on the wellhead platform.
Figure 8:
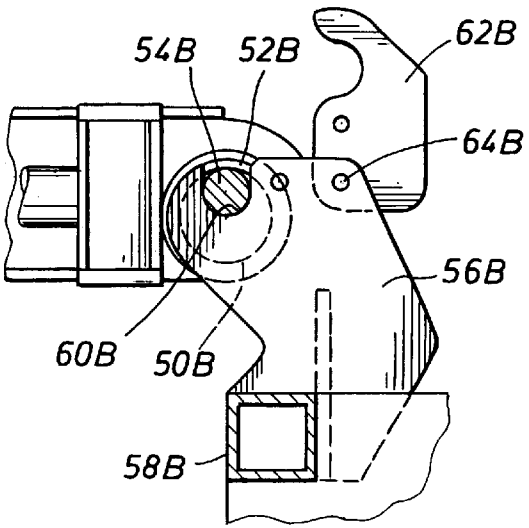
FIG. 8 is a section taken generally along the line 8—8 of FIG. 7.
Figure 7:
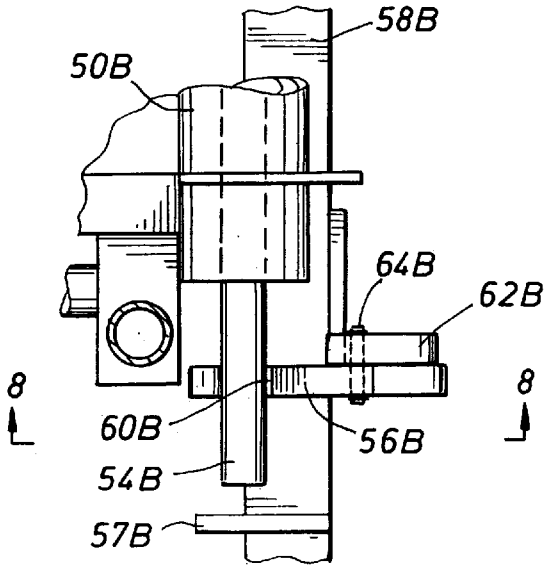
FIG. 7 is a top plan of a connection between the walkway and adjacent wellhead platform and also illustrated at 7 in FIG. 1.
Figure 10:
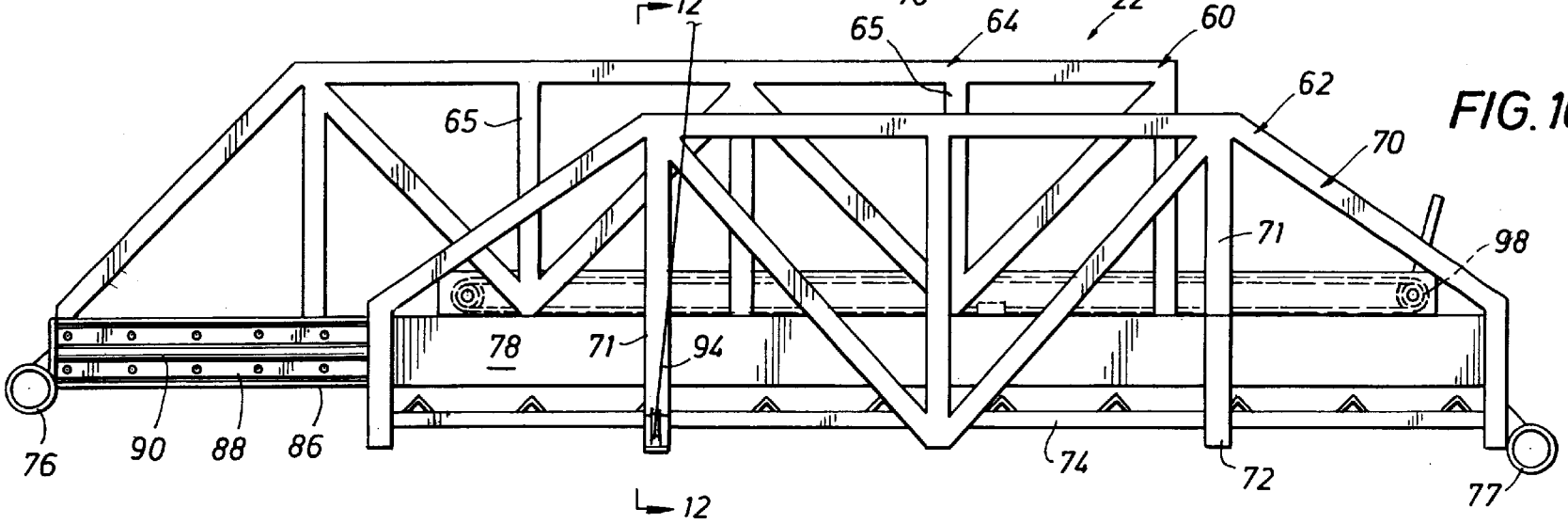
FIG. 10 is a side elevation view of another embodiment of a walkway for mounting between a wellhead platform and production deck of a marine structure.

To connect walkway 24 to a platform, a tubular member 50B having a wear sleeve 52B is secured to an end of lower walkway sliding section 26B as shown particularly in FIGS. 7–9. An adjacent end member 58B of the platform and brackets 56B extending upwardly from end member 58B are provided adjacent tubular member 50B. A removable mounting rod 54B is arranged to be received within tubular member 50B and mounted between end stop plates 57B secured to end member 58B. As shown in FIGS. 7–9, rod 54B is received within tubular member 50B and positioned within slots or notches 60B in brackets 56B between end stop plates 57B on end platform member 58B. Latch 62B is mounted about pivot 64B on bracket 56B for engaging rod 54B as shown in FIG. 9. A suitable pin or the like may be inserted in opening 66B for releasable connection of latch 62B.

Upper walkway section 26A is mounted on an adjacent platform similar to lower walkway section 26A and has a tubular member 50A receiving a rod 54A. With the connection of walkway 24 between adjacent wellhead platforms 20, any vertical or horizontal movement between the associated platforms 20 results in a sliding movement of walkway sections 26A and 26B with minimal frictional forces generated by the sliding movement of walkway sections 26A and 26B. Support rods 44A and 44B mounted within bearings are effective to minimize such frictional forces which may be generated upon relative movement of sliding sections 26A and 26B.

Support rod 54B has a diameter substantially less than the inner diameter of wear sleeve 52B, such as five times less. For example, rod 54B may have a diameter of one inch while the inner diameter of sleeve 52B may have a diameter of five inches. This permits limited rotational movement of walkway 24B relative to the adjacent wellhead platforms 20 and facilitates connection of support rods 54A and 54B to adjacent platforms.

EMBODIMENT OF FIGS. 10–12

Walkway or ramp 22 extends between production deck 12 and a wellhead platform 20. Walkway 22 comprises an upper slidable walkway section 20 and a lower slidable section 22 supporting upper section 60. Upper slidable section 60 has a pair of side handrail structures 64 including a plurality of vertical frame members 65 extending from horizontal base members 66 which support grated deck 68. Lower slidable section 62 has a pair of handrail structures 70 including a plurality of vertical frame members 71 extending upwardly from horizontal base frame members 72 and supporting a deck or floor 74. Handrail structures 64 are spaced inwardly of side rail structures 70.

A tubular end member 76 on inner slidable section 60 and a tubular end member 77 on outer slidable section 62 are provided for mounting of walkway or ramp 22 onto production deck 12 and wellhead platform 20 utilizing support rods similar to the support rods for mounting the walkway shown in FIGS. 2–9. Lower slidable section 62 is normally mounted first on production deck 12 while upper slidable section 60 is mounted on wellhead platform 20 in a manner similar to the embodiment of FIGS. 2–9 and as shown particularly in FIGS. 7–9.

Upper slidable section 60 is supported on lower slidable section 62 for sliding movement. Lower slidable section 62 has a channel-shaped side beam 78 extending along opposed sides thereof and secured to vertical frame members 71 for extending the length of lower sliding section 62. A bearing member 80 is bolted to beam 78 and has a pocket 81 with a slot 82 leading from pocket 81. Inner sliding section 60 has a channel-shaped side beam 86 mounted on vertical frame members 65 and extending along opposed sides of sliding section 60. A T-shaped rail or bar 88 is bolted to beam 86 and has a head 90 received within pocket 81 on bearing member 80 secured to side beam 78 on lower section 62. A suitable wear sleeve is positioned in pocket 81 of bearing member 80.

Walkway or ramp 62 may be of a substantial length, such as fifteen or thirty feet for example. Normally for mounting of walkway 22, tubular member 77 on lower walkway section 62 is first connected by a suitable support rod to production platform 12 while the opposed end of walkway 22 is supported on cable 94 supported from a crane and extending about pulleys 96 which are mounted on lower sliding section 62. Tubular member 77 is mounted on production platform 12 in a manner similar to the embodiment of FIGS. 2–9.

Figure 12:
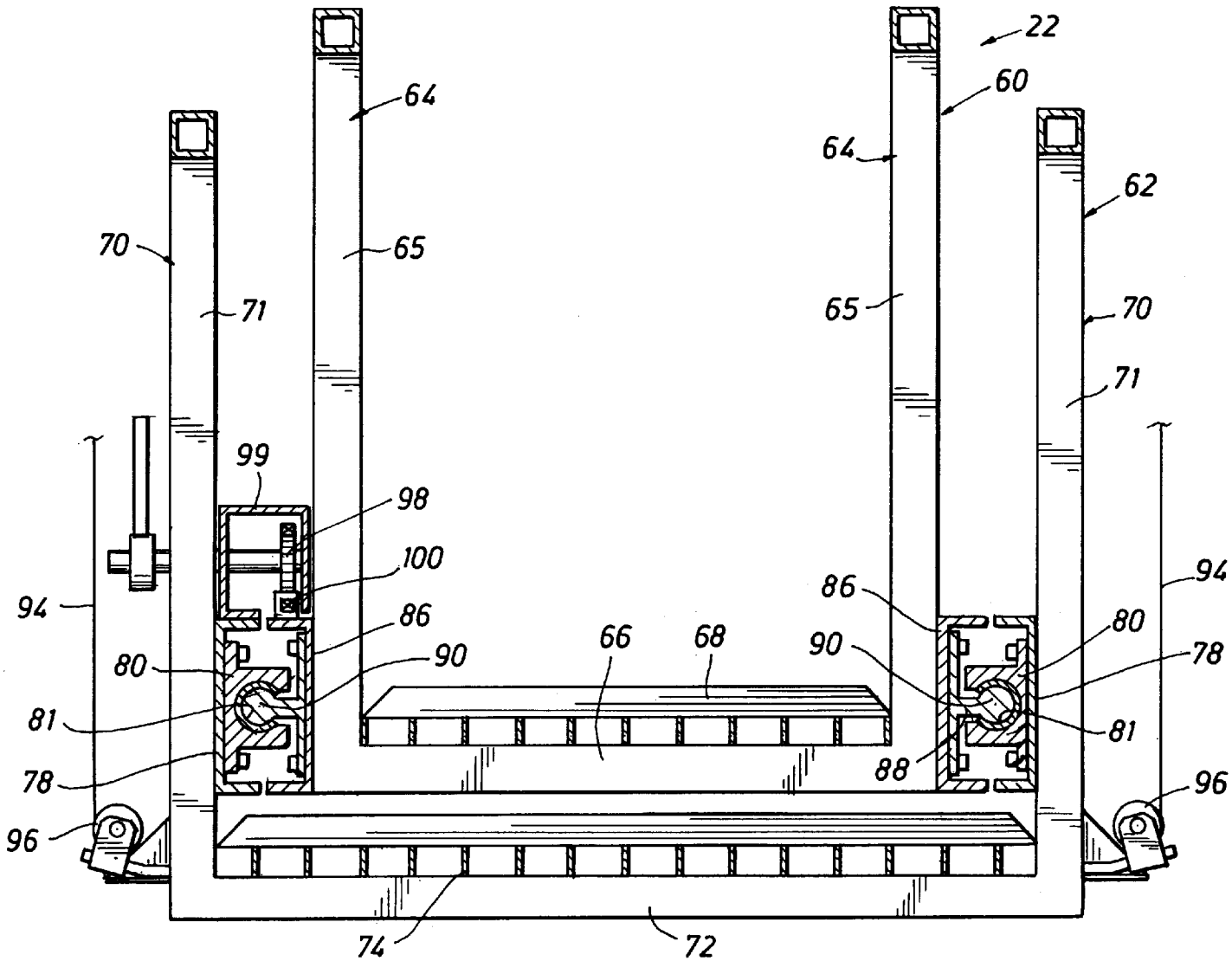
FIG. 12 is a section taken generally along the line 12—12 of FIG. 10 and showing upper and lower walkway sections in a supporting relation to each other.

To position upper slidable section 60 adjacent wellhead platform 12, a hand operated spur gear 98 is mounted within housing 99 secured to a side beam 78 and engages a rack 100 on side beam 86 as shown particularly in FIG. 12 to move inner slidable section 62 upon rotation of spur gear 98. Inner section 62 and tubular member 76 positioned at a desired location at which a suitable mounting rod may be inserted within tubular member 76 to mount inner slidable section 60 onto an adjacent wellhead platform 12. Inner slidable section 60 slides relative to outer slidable section 62 with a minimal friction generated.

Thus, the present invention provides a walkway for extending between a pair of marine structures such as platforms or decks on marine vessels, wellhead structures, or other types of marine structures. The walkway comprises a pair of sliding walkway sections mounted for relative sliding movement in overlapping relation to each other. The walkway sections are easily attached to the adjacent marine structures and are supported by suitable rods and bearings for relative sliding movement generating minimal frictional forces. Although only two specific embodiments of the invention have been illustrated and described, it is to be understood that obvious modifications may be made without departing from the true spirit and scope of this invention.

What is claimed is:

1. A walkway for extending between a pair of adjacent platforms mounted for substantial relative movement within a moon pool of an offshore production facility, said walkway comprising:

a pair of sliding walkway sections mounted for relative sliding movement for extending between the adjacent platforms and for sliding relative to each other upon relative movement of said platforms;

a side beam extending along each side of each of said pair of walkway sections;

a connecting member on an end of each walkway section for connecting the associated walkways section to an adjacent selected platform, each connecting member comprising a tubular member on an outer extending end of each sliding walkway section arranged for receiving a supporting rod mounted on an adjacent platform;

a support rod secured to said side beam on one of said pair of walkway sections; and a bearing secured to said side beam on the other of said pair of walkway sections receiving said support rod for slidably mounting said walkway sections.

2. The walkway as defined in claim 1, further comprising:

a support rod on said side beam on the other of said pair of walkway sections; and a bearing secured to said side beam on said one of said pair of walkway sections receiving said support rod on said other of said walkway sections for slidably mounting said walkway sections.

3. The walkway as defined in claim 1, further comprising:

a support rod on each side beam of one of said walkway sections; and a bearing secured to each side beam of the other of said walkway sections receiving said support rods for slidably mounting said walkway sections.

4. The walkway as defined n claim 1, further comprising:

a deck on each of said walkway sections, the deck on one of said pair of walkway sections being positioned in an overlapping relation to the deck on the other walkway sections to form an upper walkway section and a lower walkway section.

5. The walkway as defined in claim 4, further comprising:

a side rail structure extending upwardly from opposed sides of each of said pair of walkway sections, the side rail structure adjacent the upper walkway section being positioned inwardly of the side rail structures adjacent the lower walkway section.

6. The walkway as defined in claim 1, further comprising:

a manually operated drive mechanism for manually moving said sliding walkway sections relative to each other.

7. The walkway as defined in claim 6, wherein said manually operated drive mechanisms comprises a rack and pinion drive mechanism.

8. The walkway as defined in claim 1, wherein each side beam on each of said pair of walkway sections has a support rod secured thereto, and a pair of end bearings for receiving an associated support rod, said upper walkway section having an intermediate bearing secured to each side beam thereof to support the support rods on the lower walkway section.

9. The walkway as defined in claim 8, wherein said side beams on each side of said sliding sections are in vertical overlapping relation to each other and said support rods on each side of said sliding sections are in vertical alignment with each other.

10. The walkway as defined in claim 8, wherein said side beams and said support rods are in side by side relation to each other on each side of said sliding sections.

11. A walkway of extending between a pair of platforms mounted for substantial relative movement, said walkway comprising;

a pair of sliding walkway sections mounted for relative sliding movement for extending between a pair of adjacent platforms and for sliding relative to each other upon relative vertical movement of said platforms, said walkway sections each having a beam along each side thereof, each beam having a rod and a bearing member supported by the rod, the rods on one walkway section being received within and supported for sliding movement by the bearing members on the other walkway section;

a pair of connecting members for connecting each of said sliding sections to an adjacent selected platform; and each connecting member comprising a tubular member on an outer extending end of each sliding section arranged for receiving a rod mounted on an associated platform.

12. The walkway as defined in claim 11, further comprising:

a side rail structure extending upwardly adjacent each side of each walkway section, the side rail structures adjacent one walkway section being positioned inwardly of said side rail structures on the other walkway section.

13. An offshore marine structure having an upper platform with a moon pool therein, a plurality of wellhead assemblies in said moon pool including wellhead platforms positioned adjacent wellheads within the moon pool, and a walkway extending between a pair of selected wellhead platforms so that workmen may walk between said pair of selected platforms; said walkway comprising:

a pair of walkway sections mounted for relative sliding movement for extending between said pair of selected platforms, said sections mounted in sliding relative to each other upon relative vertical movement between said pair of selected platforms; and a connecting member for connecting each of said sliding sections to an adjacent selected platform.

14. The offshore marine structure as defined in claim 13, further comprising:

intermitting connecting members on each sliding section and on an adjacent selected platform for connecting the sliding sections to the pair of selected platforms to permit relative movement between the selected platforms.

15. The offshore marine structure as defined in claim 14, wherein one of said intermitting connecting members comprise a tubular member and the other of said interfitting connecting members comprise a rod received loosely within said tubular member to permit relative vertical and horizontal movements between said intermitting connecting members.

16. The offshore marine structure as defined in claim 13, wherein said walkway extends between said upper platform and a wellhead platform extending within the moon pool.

17. The offshore marine structure as defined in claim 13, wherein said walkway extends between a pair of wellhead platforms.

18. The offshore marine structure as defined in claim 13, wherein said walkway sections have floors which overlap each other.

19. The offshore marine structure as defined claim 13, wherein said walkway sections have floors defining inner extending end portions overlapping each other and connected to each other for relative sliding movement.

20. The offshore marine structure as defined in claim 19, further comprising:

a support beam on each side of each floor, the support beams on adjacent sides of said floors having guide rails connected to each other of guiding and supporting said floors for relative sliding movement.

21. A method for releasably connecting a walkway beween a pair of adjacent marine structures arranged for movement relative to each other comprising:

providing a walkway having a pair of slidable walkway sections mounted for relative sliding movement to each other for extending between the pair of adjacent marine structures;

providing on an extending end of each of said sliding walkway sections a tubular member extending for substantially the entire width of the walkway section;

mounting a supporting rod within the tubular member on each walkway section with the supporting rod being in supporting relation to the adjacent marine structure; and releasably connecting the extending ends of said supporting rod to the adjacent marine structure on each of the walkway sections thereby to detachably connect the walkway to a pair of adjacent marine structures.

* * * * *